United States Patent [19]

Barner

[11] 4,191,413

[45] Mar. 4, 1980

[54] TRUNK RETAINER ASSEMBLY

[76] Inventor: Harold R. Barner, 9361 Alto Dr., La Mesa, Calif. 92041

[21] Appl. No.: 966,766

[22] Filed: Dec. 6, 1978

[51] Int. Cl.[2] ..... E05C 17/00

[52] U.S. Cl. ..... 292/262; 24/73 A; 24/191

[58] Field of Search ..... 292/262, 288; 24/73 A, 24/191, 170, 193, 72.5

[56] References Cited

U.S. PATENT DOCUMENTS

| | | | |
|---|---|---|---|
| 2,983,413 | 5/1961 | Verwers | 24/73 A X |
| 3,046,056 | 7/1962 | Greene et al. | 24/193 |
| 3,127,652 | 4/1964 | Springer | 24/193 X |
| 3,253,309 | 5/1966 | Baresch | 24/170 |
| 3,891,257 | 6/1975 | Wilson | 292/262 |
| 3,980,202 | 9/1976 | Monyak et al. | 292/288 X |

*Primary Examiner*—Richard E. Moore
*Attorney, Agent, or Firm*—Charles C. Logan, II

[57] ABSTRACT

A trunk retainer assembly for an automobile that provides a structure for holding the trunk lid securely when an oversized load has been placed into the automobile trunk compartment that necessitates the trunk lid being left in a partially open position. The trunk retainer assembly has an elongated strap and a buckle. The buckle has a strap attaching portion, an intermediate portion, and a mounting portion. The strap attaching portion has a pair of longitudinally spaced slots, one of these being a top slot and the other a bottom slot. These slots extend laterally with respect to the longitudinal axis of the strap attaching portion whereby the strap may be threaded through the top slot and then direction reversed 180 degrees so that it can be threaded downwardly through the bottom slot. The mounting portion of the buckle has an aperture adjacent its upper end through which a threaded bolt passes for securing the buckle to the interior of the trunk lid. The longitudinal axis of the mounting portion of the buckle and the longitudinal axis of the strap attaching portion of the buckle are laterally offset and interconnected between them by the diagonally oriented intermediate portion of the buckle. Adjacent the lower end of the strap is an aperture through which passes a threaded bolt which is secured to a mounting plate on the inside of the trunk compartment. The height of the open trunk lid can thus be varied by cinching up the strap or loosening it depending upon the height of the articles carried in the trunk.

4 Claims, 3 Drawing Figures

TRUNK RETAINER ASSEMBLY

BACKGROUND OF THE INVENTION

The invention relates to a restraining strap assembly, and more specifically to a trunk retainer assembly for an automobile.

In the past a problem has existed for automobile owners on occasions when they were required to carry an excessively large amount of objects or objects of size such that the trunk lid of the automobile could not be fully closed. An example of such a situation is the annual pilgramage to pick up the family Christmas tree that is normally placed into the trunk of the automobile. On this and other similar occasions the problem has usually been resolved by tieing down the trunk lid with one or more pieces of rope. One of the headaches of this solution normally comes about from the difficulty of finding structure to which to tie the ends of the rope. Another frequent problem is the lack of rope to tie the trunk lid down when it is needed.

It is an object of the invention to provide a novel device for securing the trunk lid of an automobile when it can't be fully closed due to the size or amount of objects loaded in the trunk compartment.

It is another object of the invention to provide a novel trunk retainer assembly that is easy to install and remove.

It is also an object of the invention to provide a novel trunk retainer assembly that is inexpensive to manufacture.

It is a further object of the invention to provide a novel trunk retainer assembly that can be marketed for a reasonal price.

It is an additional object of the invention to provide a novel trunk retainer assembly that can fit practically all makes and models of automobiles.

SUMMARY OF THE INVENTION

The novel trunk retainer assembly comprises two basic components, the elongated strap and the buckle. Adjacent one end of the strap is found an aperture through which a threaded bolt may be inserted after it has previously been unscrewed from a mounting plate such as that of the keeper assembly. Since an existing bolt and threaded bore hole are utilized, there is no necessity to drill any holes in order to attach the strap within the trunk. Once the strap has been installed it is not necessary to remove it between occasions upon which it utilized. Effectively once it has been installed it will be always ther ready for usage. Also the strap could either be rolled up in a coil with a rubber band around it or merely allowed to lay in the bottom of the trunk compartment itself.

The buckle is the other major component of the trunk retainer assembly and it has an aperture adjacent its top end of mounting portion. In a similar manner to that utilized for attaching the strap member, a threaded bolt is inserted through the aperture for securing the buckle to the inside of the trunk lid. The bolt used to perform this function would be one from the trunk latch mechanism mounting plate and thus no additional bolt would be required nor would it be necessary to drill a hole in the interior structure of the trunk lid. The length of the buckle member would be fairly short and its lower strap attaching portion would extend only slightly below the bottom of the lip of the trunk lid. Accordingly the buckle member could also be left in position once it has been installed so that it would always be ready for utilization when necessary. The strap attaching portion of the buckle has a pair of longitudinally spaced slots through which the free end of the strap would be threaded. In normal operation the free end of the strap would be threaded through the top slot first and then its direction would be reversed 180 degrees so that it could downwardly through the bottom slot. After this the required amount of cinching required to pull the trunk lid down against the top of the objects found within the trunk compartment could be determined.

DESCRIPTION OF THE PREFERRED EMBODIMENT

Figure 1:
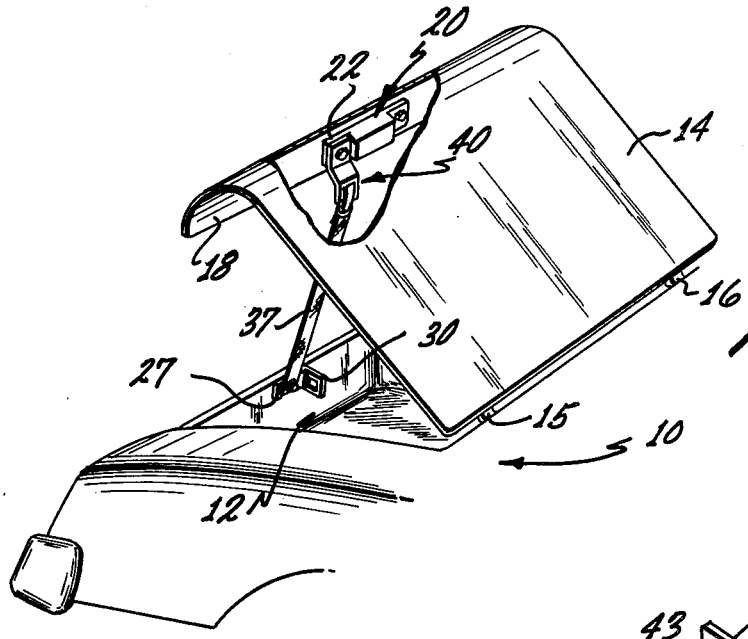
FIG. 1 is a partial perspective view of the trunk compartment of an automobile with portions broken away for clarity.
Figure 2:
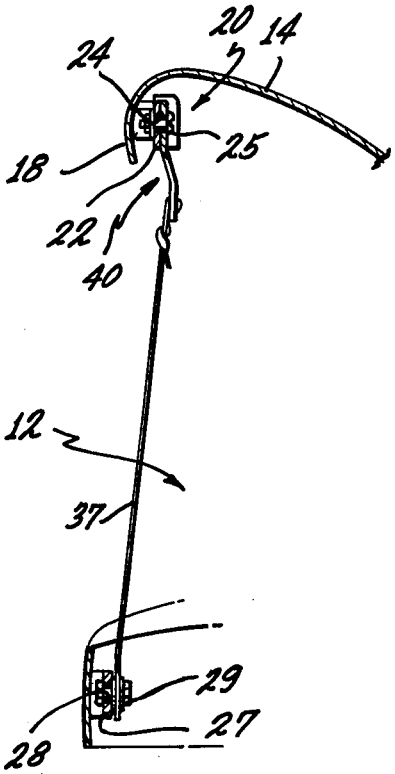
FIG. 2 is a partial cross section elevation view illustrating how the novel trunk retainer assembly is attached to the automobile trunk.
Figure 3:
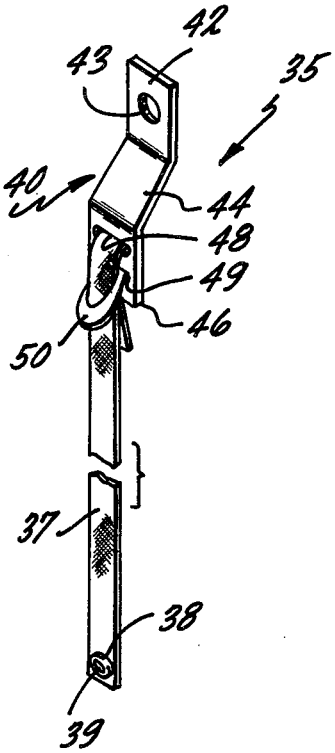
FIG. 3 is a perspective view of the novel trunk retainer assembly.

Referring now to FIGs. 1-3, the novel trunk retainer assembly and its manner of attachment to the trunk structure of an automobile will now be described. The automobile is generally designated numeral 10. The trunk compartment 12 has a trunk lid 14 hinged at its forward end by hinges 15 and 16.

Secured to the underside of the trunk lid on the lip portion, 18, is the trunk latch mechanism 20 which has a latch mounting plate 22. The latch mounting plate 22 has a bore hole 24 into which is threaded bolt 25.

In the trunk compartment along the back wall thereof, a keeper mounting plate 27 forms a portion of the keeper member 30. Keeper mounting plate 27 has a bore hole 28 therein in which bolt 29 is threadably secured.

In FIG. 3 the structure of the strap 37 and the buckle 40 is clearly illustrated. At the bottom end of the strap is found a grommet 38 having an aperture 39 therein. The buckle 40 has amounting portion 42, an intermediate portion 44, and a strap attaching portion 46. An aperture 43 is formed in the mounting portion 42 and it is through this opening that the threaded shank of bolt 25 passes for securing the buckle to the trunk lid 14. The strap attaching portion 46 has a pair of longitudinally spaced slots 48 and 49 through which the free end of strap 37 is threaded. A loop member 50 may also be attached to strap attaching portion 46.

What is claimed is:

1. In combination with an automobile having a trunk compartment with a trunk lid hinged adjacent its forward end forming the top surface of the trunk compartment, a trunk retainer assembly comprising:

an elongated strap, a buckle having a strap attaching portion, an intermediate portion, and a mounting portion, means for detachably securing one end of said elongated strap to said buckle, comprising a pair of longitudinally spaced slots on said strap attaching portion of the buckle, one of said slots being a top slot and the other a bottom slot, said slots extending laterally with the longitudinal axis of said strap attaching portion whereby said strap can be threaded through said top slot and then its direction reversed 180 degrees so that it can be threaded downwardly through said bottom slot.

means for detachably securing one end of said elongated strap to the interior of said trunk compartment, and means for detachably securing said buckle to the interior of said trunk lid.

the longitudinal axis of said mounting portion of said buckle and the longitudinal axis of said strap attaching portion of said buckle are laterally offset and interconnected between them by the diagonally oriented intermediate portion of said buckle thereby allowing the trunk lid to be closed while buckle is secured to the inside surface of the trunk lid.

2. The combination of an automobile trunk and trunk retainer assembly as recited in claim 1 wherein said means for detachably securing one end of said elongated strap to the interior of said trunk compartment comprises a mounting plate secured to the inside of said trunk compartment, a bore hole in said mounting plate, an aperture adjacent the lower end of said strap, and a bolt whose threaded shank portion passes through said aperture and bore hole.

3. The combination of an automobile trunk and trunk retainer assembly as recited in claim 1 wherein said means for detachably securing said buckle to the interior of said trunk lid comprises a mounting plate secured to the inside of said trunk lid, a bore hole in said mounting plate, an aperture adjacent the top end of said buckle, and a bolt whose threaded shank portion passes through said aperture and bore hole.

4. The combination of an automobile trunk and trunk retainer assembly as recited in claim 1 wherein said elongated strap is formed of nylon.

* * * * *